US005668557A

United States Patent [19]

Kawahata

[11] Patent Number: 5,668,557

[45] Date of Patent: Sep. 16, 1997

[54] SURFACE-MOUNT ANTENNA AND COMMUNICATION DEVICE USING SAME

[75] Inventor: Kazunari Kawahata, Kyoto, Japan

[73] Assignee: Murata Manufacturing Co., Ltd., Japan

[21] Appl. No.: 596,513

[22] Filed: Feb. 5, 1996

[30] Foreign Application Priority Data

Feb. 3, 1995 [JP] Japan ..... 7-017242

[51] Int. Cl.[6] ..... H01Q 1/38

[52] U.S. Cl. ..... 343/700 MS; 343/702; 343/829

[58] Field of Search ..... 343/700 MS, 702, 343/715, 803, 829, 830

[56] References Cited

U.S. PATENT DOCUMENTS

| | | | |
|---|---|---|---|
| 2,994,876 | 8/1961 | Josephson | 343/803 |
| 3,599,214 | 8/1971 | Atmayer | 343/803 X |
| 4,015,265 | 3/1977 | Dubust et al. | 343/803 X |
| 4,518,968 | 5/1985 | Hatley | 343/803 X |
| 4,929,961 | 5/1990 | Nakase | 343/829 X |
| 5,262,795 | 11/1993 | Demarre et al. | 343/829 |
| 5,307,078 | 4/1994 | Tanaka et al. | 343/829 X |
| 5,349,361 | 9/1994 | Egashira et al. | 343/715 |

*Primary Examiner*—Donald T. Hajec
*Assistant Examiner*—Tho Phan
*Attorney, Agent, or Firm*—Ostrolenk, Faber, Gerb & Soffen, LLP

[57] ABSTRACT

A surface-mount antenna using a dielectric base of a relatively low dielectric constant to obtain a wide frequency band and a small size. There is also disclosed a communication device using such a surface-mount antenna. The antenna comprises a dielectric base provided with at least one hole extending through the base between two opposite end surfaces of the base. A radiating electrode is formed in the hole. One end of the radiating electrode is connected with a grounding electrode which is formed at one end surface of the dielectric base. The other end of the radiating electrode is connected with a feeding terminal via a capacitor.

7 Claims, 5 Drawing Sheets

FIG. 3
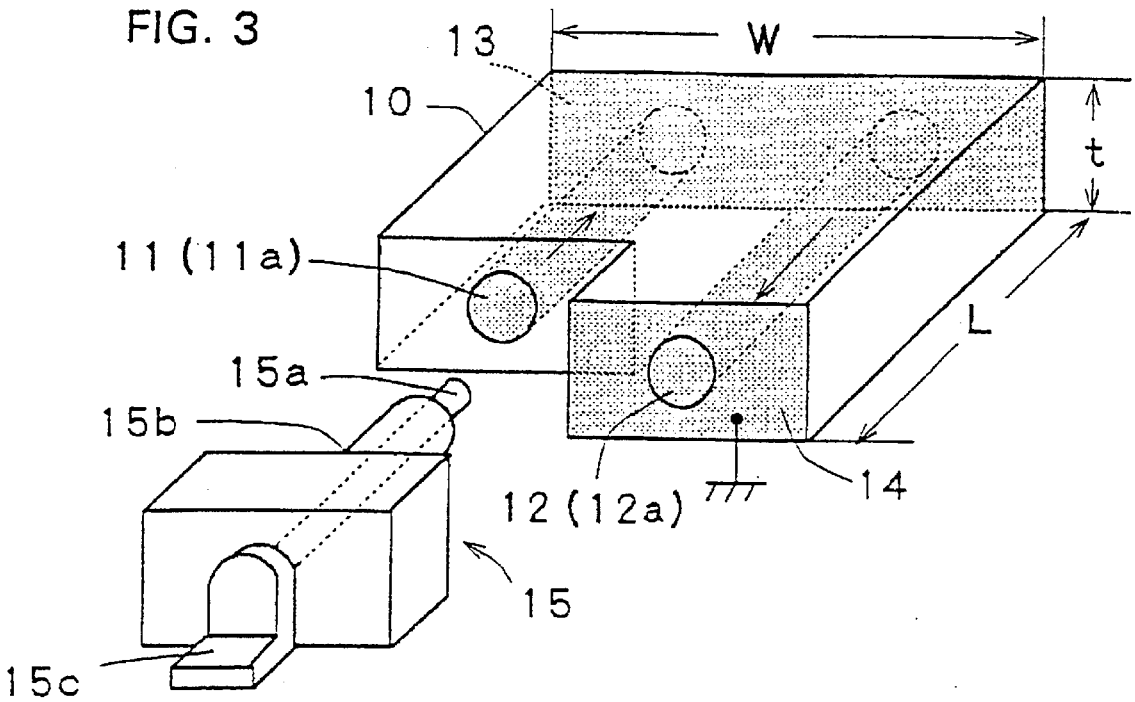
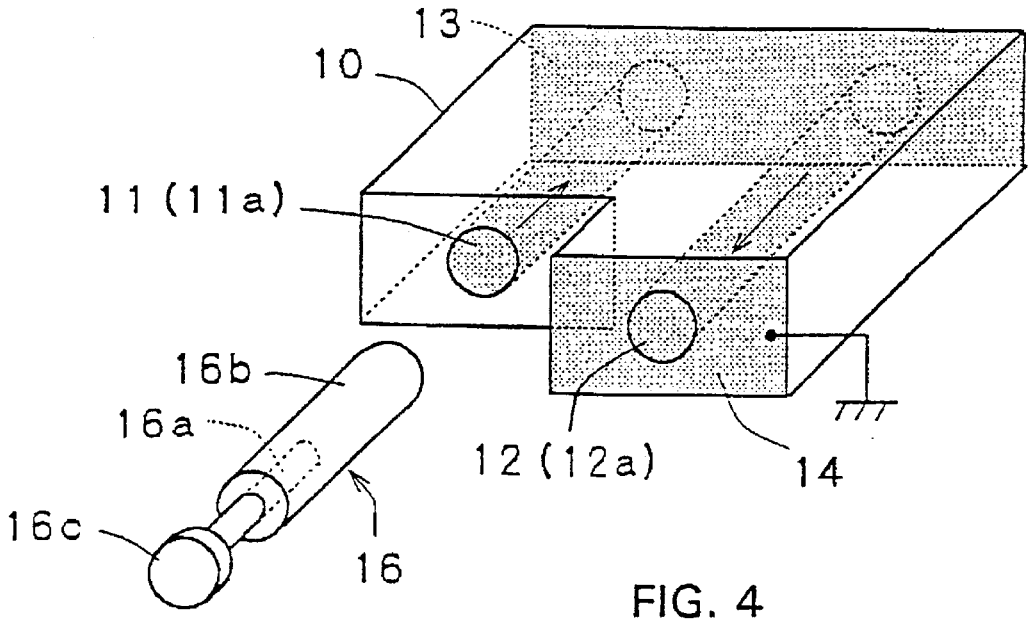
FIG. 4

FIG. 5
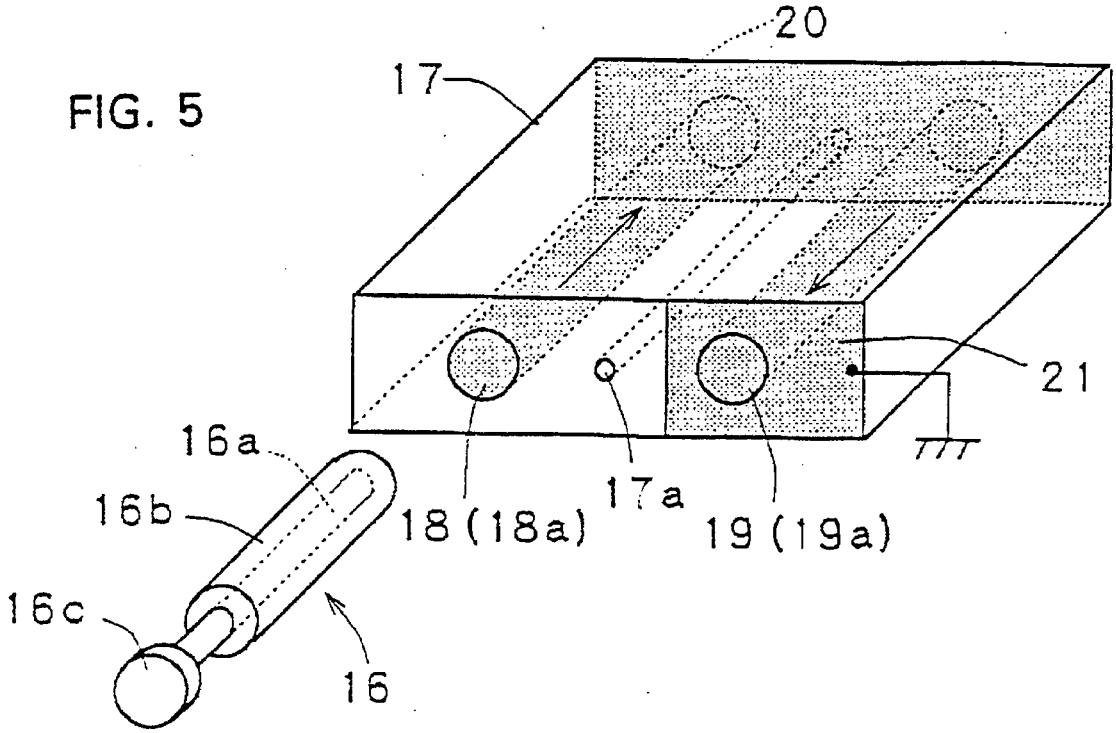
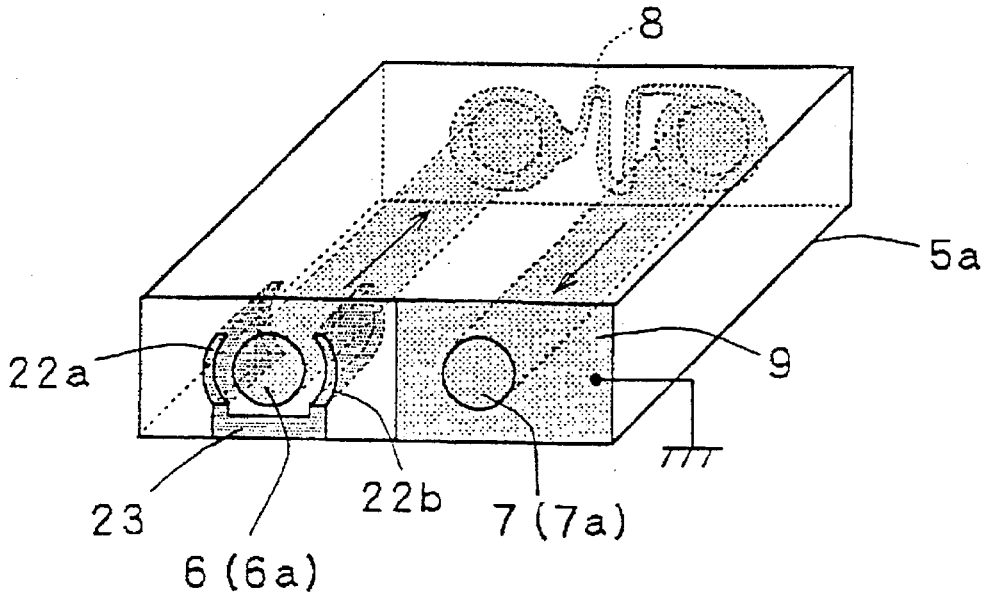
FIG. 6

SURFACE-MOUNT ANTENNA AND COMMUNICATION DEVICE USING SAME

BACKGROUND OF THE INVENTION

1. Field of the Invention

The present invention relates to a surface-mount antenna for use in a mobile communication device (such as a mobile phone) and in a wireless local-area network (LAN). The invention also relates to a communication device using such a surface-mount antenna.

2. Description of the Related Art

A prior art surface-mount antenna is shown in FIG. 10. This antenna comprises a rectangular dielectric base 31 made of a ceramic, resin, or the like. A hole 32 extends through the base 31 between two opposite end surfaces of the base 31. A radiating electrode 32*a* is formed inside the hole 32. A capacitance loading electrode 35 is formed at a first end surface of the dielectric base 31 and connected with a first end of the radiating electrode 32*a*. A feeding electrode 33 is formed at the second end surface of the dielectric base 31 and connected with the second end of the radiating electrode 32*a*. Grounding electrodes 34*a* and 34*b* are formed on opposite sides, respectively, of the second end surface of the dielectric base 31.

In this prior art surface-mount antenna, the capacitance between the capacitance loading electrode 35 and each of the grounding electrodes 34*a* and 34*b* must be increased in order to accomplish miniaturization while permitting surface mounting. For this purpose, it is necessary to increase the dielectric constant of the dielectric base 31, which in turn increases the Q. As a consequence, the frequency bandwidth is narrowed. Furthermore, the prior art communication device on which the prior art narrow-band, surface-mount antenna is mounted is unable to sufficiently accommodate itself to frequency deviations caused by the human body and the enclosure of the device. Another disadvantage is that the input impedance of the antenna is uniquely determined by the size of the dielectric base and by the size of the hole extending through the base.

SUMMARY OF THE INVENTION

It is an object of the present invention to provide a surface-mount antenna which uses a dielectric base of a relatively low dielectric constant but enables miniaturization to such an extent that surface mounting is possible, and whose frequency bandwidth can be widened by an amount corresponding to the decrease in the dielectric constant of the dielectric base. The antenna permits one to set the impedance to a desired value by changing the coupling capacitance.

It is another object of the invention to provide a communication device in which the surface-mount antenna described in the immediately preceding paragraph is mounted.

A surface-mount antenna according to a first embodiment of the present invention comprises a dielectric base provided with at least one hole extending through the dielectric base between two opposite end surfaces of the dielectric base, a radiating electrode formed inside the hole, a grounding electrode formed at one of said two opposite end surfaces, and a feeding terminal. One end of the radiating electrode is connected with the grounding electrode, while the other end is connected with the feeding terminal via a capacitor.

Another surface-mount antenna according to a second embodiment of the invention comprises a dielectric base provided with a plurality of holes extending through the dielectric base between two opposite end surfaces of the dielectric base, radiating electrodes formed in the holes, respectively, an electrode pattern, a feeding terminal, and a grounding electrode. The radiating electrodes are connected to each other by the electrode pattern at one of said two opposite end surfaces. At the other of said two opposite end surfaces, at least one of the plurality of radiating electrodes is connected with the feeding terminal via a capacitor, and at least another one of the radiating electrodes is connected with the grounding electrode.

A further surface-mount antenna according to a third embodiment of the invention comprises a dielectric base, a step portion formed at a first end surface of the dielectric base, a first hole having a short axial length and extending through the dielectric base between the first end surface and a second end surface opposite to the first end surface, a second hole having a long axial length and extending through the dielectric base between the first and second end surfaces, first and second radiating electrodes formed in the first and second holes, respectively, an electrode pattern which is formed at the second end surface of the dielectric base and with which the first and second radiating electrodes are connected, a feeding terminal, and a grounding electrode. At the first end surface of the dielectric base, the first radiating electrode is connected with the feeding terminal via a capacitor, and the second radiating electrode is connected with the grounding electrode.

Yet another surface-mount antenna is based on the surface-mount antenna according to the second embodiment of the invention and is further characterized in that an electrodeless hole is formed between the two opposite end surfaces of the dielectric base and located between the aforementioned holes extending through the dielectric base.

In still another feature of the invention, a metal rod is covered with a dielectric member and coupled to the feeding terminal, and the aforementioned capacitor is created by the metal rod, the radiating electrode, and the dielectric member therebetween.

In a still further feature of the invention, the aforementioned capacitor is formed by a part of the dielectric base which is located between the radiating electrode and the feeding electrode, the feeding electrode being formed in the dielectric base.

The present invention also relates to a communication device having the above-described surface-mount antenna mounted therein.

In the present invention, the radiating electrode formed in a hole extending through the dielectric base is coupled to the feeding terminal via the capacitor. The radiation resistance and the resonant frequency can be controlled by increasing or reducing the capacitance of the capacitor. For example, if the capacitance of the capacitor is increased, then the resonant frequency drops. The frequency bandwidth can be widened by adjusting the capacitor and using a dielectric base of a lower dielectric constant. Also, the size can be reduced.

Further miniaturization can be accomplished by providing a plurality of holes which extend through the dielectric base and are each equipped with radiating electrodes, respectively, and interconnecting these holes by a conductive pattern.

Where a plurality of holes extend through the dielectric base and are each equipped with radiating electrodes, respectively, one of the holes can be used mainly for coupling purposes. Another can be used mainly for radiating electromagnetic waves.

When the aforementioned holes (or radiating electrodes) are connected by the electrode pattern formed on the dielectric base, electrical currents flowing in different directions are induced. Therefore, the field directivity pattern has less of a null point.

In a communication device in which a surface-mount antenna according to above embodiments of the invention is mounted, the length of the leads connected to the RF circuit portion for processing input/output signals from the antenna can be reduced to a minimum.

Other features and advantages of the present invention will become apparent from the following description of the invention which refers to the accompanying drawings.

BRIEF DESCRIPTION OF THE DRAWINGS

FIG. 3 is an exploded perspective view of a further surface-mount antenna according to a third embodiment of the invention;

FIG. 4 is an exploded perspective view of a surface-mount antenna corresponding to that shown in FIG. 3, including a modification of the feeding terminal;

FIG. 5 is an exploded perspective view of a surface-mount antenna according to a fourth embodiment of the invention;

FIG. 6 is an exploded perspective view of a surface-mount antenna corresponding to that shown in FIG. 2, showing a modification of the feeding terminal;

DETAILED DESCRIPTION OF EMBODIMENTS OF THE INVENTION

Figure 1:
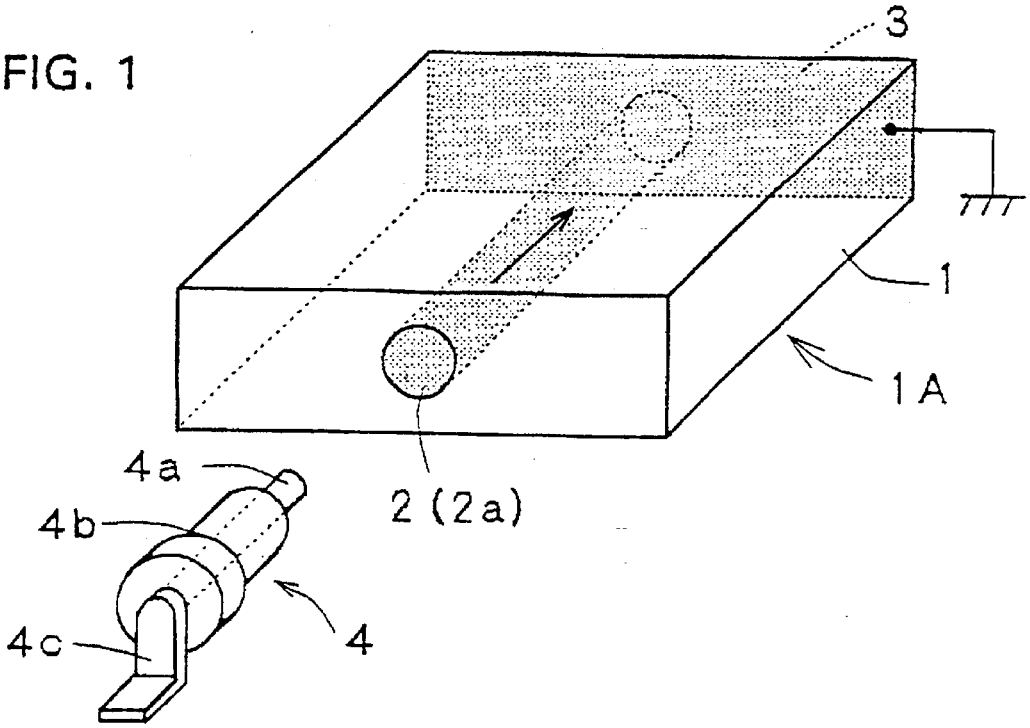
FIG. 1 is an exploded perspective view of a surface-mount antenna according to a first embodiment of the invention.

Referring to FIG. 1, there is shown a surface-mount antenna embodying the concept of the present invention. This antenna, generally indicated by 1A, comprises a rectangular dielectric body or base 1 made of a ceramic, resin, or the like. A hole 2 extends through the dielectric base 1 between two opposite end surfaces of the base 1. A radiating electrode 2*a* is formed in the hole 2. A grounding electrode 3 is formed at one end surface of the dielectric base 1. One end of the radiating electrode 2*a* is connected with this grounding electrode 3.

A feeding device, generally indicated by reference numeral 4, has a metal rod 4*a* and a feeding terminal 4*c* connected to the root portion of the metal rod 4*a*. The metal rod 4*a* is covered with a dielectric member 4*b* made of a resin or the like. The dielectric member 4*b* has a thin front end portion and a thick rear end portion. The thin front end portion of the feeding device 4 is inserted in the hole 2 extending through dielectric base 1. A capacitance is created between the metal rod 4*a* and the radiating electrode 2*a* in the hole 2 via the dielectric member 4*b*. The rear end portion of the feeding device 4 acts as a stop when the feeding device is inserted into the hole 2.

Figure 9:
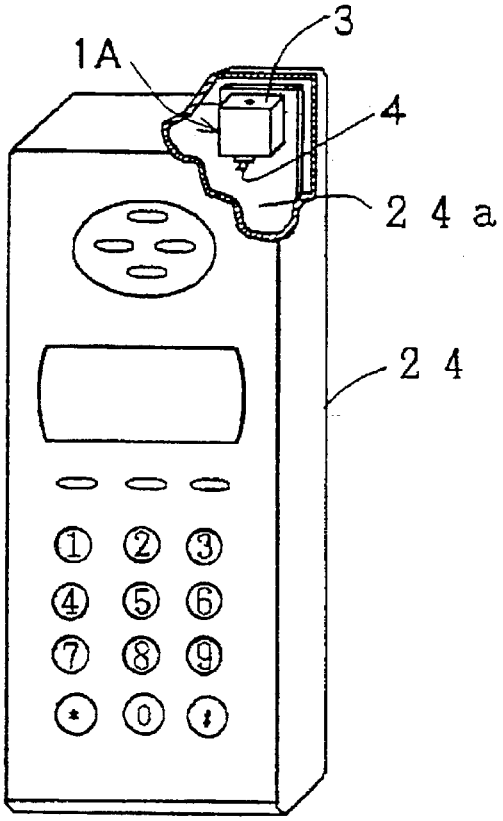
FIG. 9 is a partially cutaway perspective view of a communication device in which a surface-mount antenna according to an embodiment of the invention is mounted.
Figure 10:
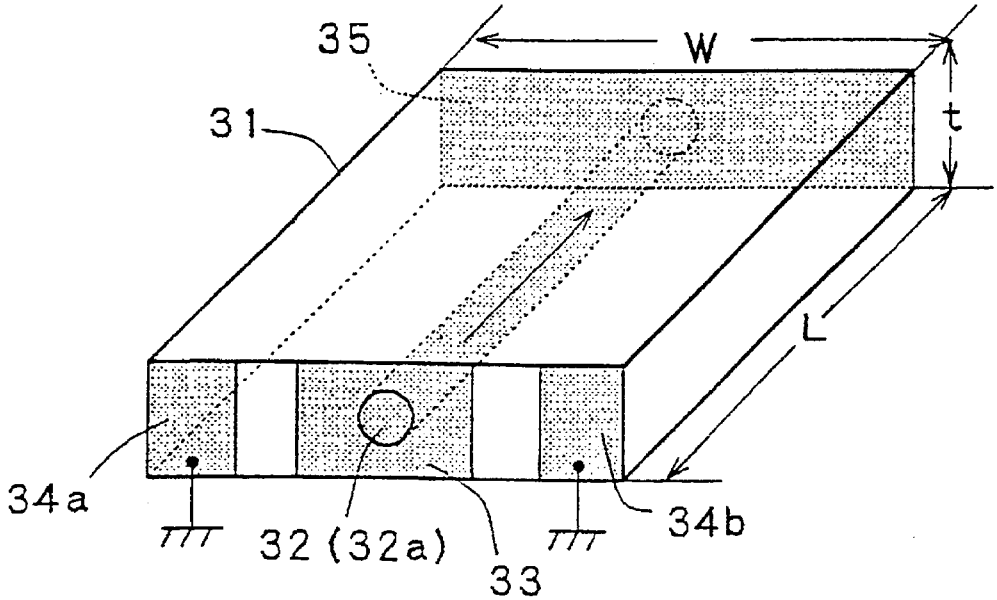
FIG.10 PRIOR ART
FIG. 10 is a perspective view of the prior art surface-mount antenna.

As shown in FIG. 9, the surface-mount antenna 1A of the present example is mounted to a mounting board 24*a* or a subsidiary mounting board in a communication device 24 by soldering the feeding device 4 and grounding electrode 3 to respective signal and ground conductors on the mounting board.

In the present example, the radiating electrode 2*a* is coupled to the feeding terminal 4*c* via the capacitance created in the hole 2 between the metal rod 4*a* of the feeding device 4 inserted in the hole 2 (or, the radiating electrode 2*a*) and the radiating electrode 2*a*. Therefore, the coupling is effectively done without leakage of the coupling electric field. An electric current flows from the feeding terminal 4*c* to the grounding electrode 3 as indicated by the arrow. As a result, electromagnetic waves are radiated from the outer surface of the radiating electrode 2*a*.

Figure 2:
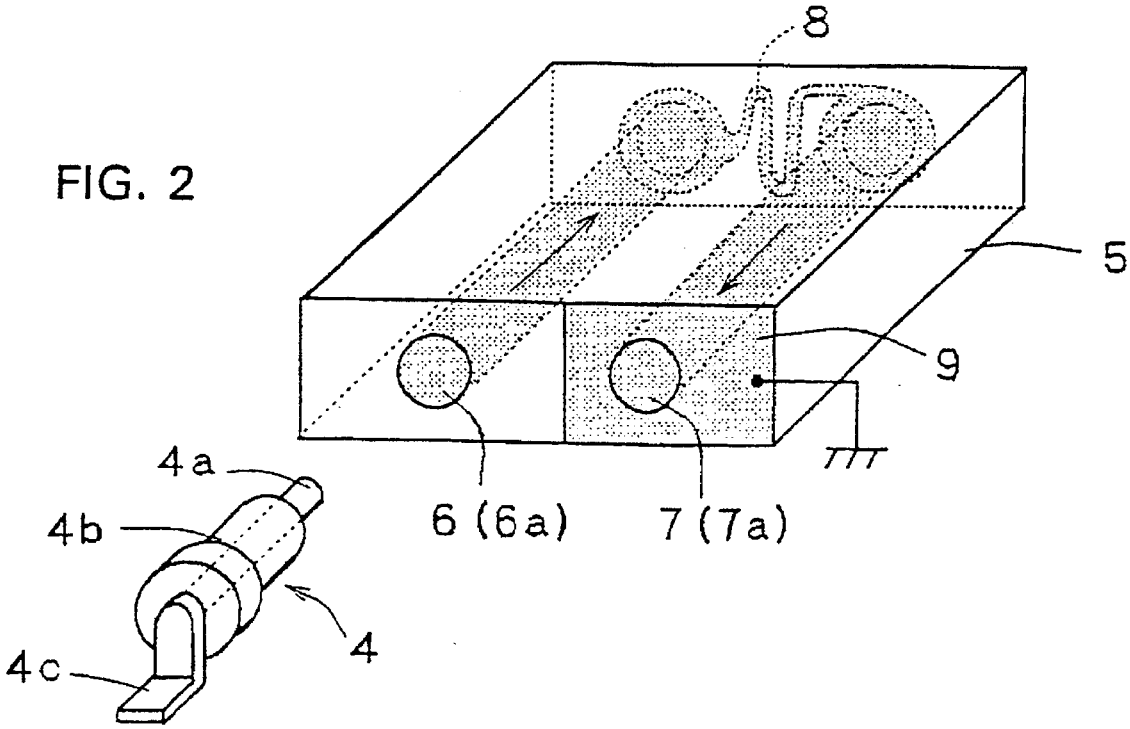
FIG. 2 is an exploded perspective view of another surface-mount antenna according to a second embodiment of the invention.

Another surface-mount antenna according to a second embodiment of the invention is next described by referring to FIG. 2. This antenna comprises a rectangular dielectric body or base 5 made of a ceramic or other material. Two holes 6 and 7 extend through the dielectric base 5 between two opposite end surfaces of the dielectric base 5. Radiating electrodes 6*a* and 7*a* are formed in the holes 6 and 7, respectively. An electrode pattern 8 forming an inductance, for example, is formed between the radiating electrodes 6*a* and 7*a* at one end surface of the dielectric base 5. A grounding electrode 9 is formed at the other end surface of the dielectric base 5 around the hole 7, and is connected with the radiating electrode 7*a*.

A feeding device 4 is similar in structure to the feeding device 4 already described in connection with FIG. 1 and will not be described further.

The operation and the functions of the present example are now described. The thin front end portion of the dielectric member 4*b* of the feeding device 4 is inserted in the hole 6. A capacitance is created between the metal rod 4*a* and the radiating electrode 6*a* via the dielectric member 4*b*. The metal rod 4*a* coupled to the feeding terminal 4*c* is electromagnetically coupled to the radiating electrode 6*a* by this capacitance. An electric current flows through the radiating electrode 6*a* in the direction indicated by the arrow. The current then flows through the electrode pattern 8 and through the radiating electrode 7*a* in the direction indicated by the arrow. The current finally reaches the grounding electrode 9. As a result, electromagnetic waves are radiated from the radiating electrode 6*a*, from the electrode pattern 8, and from the radiating electrode 7*a*.

In the present example, the surface-mount antenna is made to act as a current-inducing antenna by the connection of the radiating electrodes 6*a*, 7*a* and the electrode pattern 8. Electric currents flow through the radiating electrodes 6*a* and 7*a* in different directions. Consequently, the electromagnetic field radiation directivity pattern is made nearly non-directional. Furthermore, the effective length can be rendered large. In consequence, the device can be made small in size without the need to use a dielectric base having a high relative dielectric constant. In addition, the frequency bandwidth can be widened.

Also in the present example, the radiating electrodes 6*a* and 7*a* can be independently designed so that the electrode 6*a* acts as an electrode mainly for coupling to the feeding device 4 and that the electrode 7*a* acts as an electrode mainly for radiating electromagnetic waves. Therefore, the resonant frequency and radiation resistance can be designed with a greater degree of freedom. Matching to a desired impedance (for example, 50 Ω) can be easily made.

A further surface-mount antenna according to a third embodiment of the invention is next described by referring to FIG. 3. This antenna comprises a dielectric base 10 having a step portion which is formed by cutting out a part of the base. A hole 11 having a short axial length and a hole 12 having a long axial length extend through the dielectric base 10 between the two opposite end surfaces which are located on the opposite sides of the step. Radiating electrodes 11*a* and 12*a* are formed in the holes 11 and 12, respectively. An electrode pattern 13 for forming an inductance, for example, is formed at one end surface of the dielectric base 10. The radiating electrodes 11*a* and 12*a* are connected with this electrode pattern 13. A grounding electrode 14 is formed around the hole 12 at the other end surface of the dielectric base 10. The radiating electrode 12*a* is connected with this grounding electrode 14.

A feeding device 15 is similar in function to the feeding device 4 shown in FIGS. 1 and 2 but slightly differs in shape from the latter feeding device 4. The feeding device 15 comprises a metal rod 15*a* and a feeding terminal 15*c* connected to the root of the metal rod 15*a*. The metal rod 15*a* is covered with a dielectric member 15*b* having a cylindrical front end portion and a boxlike rear end portion. The front end portion of the dielectric member 15*b* is inserted into the hole 11. The rear end portion of the dielectric member 15*b* matches the cutout portion of the dielectric base 10 in volume. The rear end portion of the dielectric member 15*b* serves as a stop when the feeding device is inserted, and also acts to make the other end surface of the dielectric base 10 (the surface of the grounding electrode 14) flush with the surface on which the feeding terminal 15*c* of the feeding device 15 is mounted.

In the present example, the axial length of the hole 11 in which the feeding device 15 is inserted is made shorter than that of the hole 12. As a consequence, the resonant frequency can be made higher, and the radiation resistance can be made smaller. In other respects, the present example is similar to the example described in conjunction with FIG. 2 in operation and advantages.

A modified example of the feeding device 15 shown in FIG. 3 is described next by referring to FIG. 4. This feeding device, indicated by numeral 16, is similar to the feeding device 15 shown in FIG. 3 except that a dielectric member slightly longer than the dielectric member shown in FIG. 3 is used. That is, a dielectric member 16*b* protruding from the front end of the metal rod 16*a* is formed at the front end of the metal rod 16*a* connected with the feeding terminal 16*c*.

The dielectric member 16*b* of the feeding device 16 is made longer to permit the front end to be welded after the feeding device 16 is inserted deep into the radiating electrode 11*a*.

Referring next to FIG. 5, there is shown a surface-mount antenna according to a fourth embodiment of the invention. This antenna comprises a dielectric base 17 provided with an electrodeless hole 17*a* extending through the base between two opposite end surfaces of the base 17. The dielectric base 17 is further provided with a plurality of holes 18 and 19 extending through the base. The holes 18 and 19 are located on opposite sides of the electrodeless hole 17*a*. Radiating electrodes 18*a* and 19*a* are respectively formed in the holes 18 and 19. An electrode pattern 20 forming an inductance, for example, is formed at one end surface of the dielectric base 17. Radiating electrodes 18*a* and 19*a* are connected with this electrode pattern 20. A grounding electrode 21 is formed around the hole 19 at the other end surface of the dielectric base 17. The radiating electrode 19*a* is connected with this grounding electrode 21. A feeding device 16 is the same as the feeding device 16 shown in FIG. 4 and will not described below.

The present example is characterized in that the electrodeless hole 17*a* in which no electrode is provided exists between the radiating electrodes 18*a* and 19*a*. The inside of the electrodeless hole 17*a* is filled with air having a dielectric constant almost equal to unity. Therefore, if the spacing between the radiating electrodes 18*a* and 19*a* is close, the mutual coupling thereof is decreased by the hole 17*a*. As a consequence, the directivity characteristic is free from any abnormal null point or the like.

Referring next to FIG. 6, there is shown a surface-mount antenna having a dielectric base 5*a* similar to the dielectric base 5 described in connection with FIG. 2. It is to be noted that like components are indicated by like reference numerals in the various figures. In the above examples, the feeding devices 4, 15, and 16 have been designed to be inserted into their respective holes provided with their respective radiating electrodes. In the present example, however, a feeding device is mounted on the dielectric base 5*a* outside a radiating electrode. Specifically, electrodes 22*a* and 22*b* are mounted on opposites sides of a radiating electrode 6*a*. Capacitances are created between the radiating electrode 6*a* and the electrodes 22*a* and 22*b*, respectively, while using a part of the dielectric base 5 as a dielectric member. The electrodes 22*a* and 22*b* are connected with a feeding terminal 23. These capacitances couple the feeding terminal 23 to the radiating electrode 6*a*. In the present example, the feeding terminal 23 and other components are formed integrally with the dielectric base 5. As a result, the size is reduced further.

In the present example, the electrodes 22*a* and 22*b* are formed inside the dielectric base 5. Instead, these electrodes may be formed outside the dielectric base. Furthermore, the electrodes 22*a* and 22*b* may be annular and joined together, forming an integrated structure.

Figure 7:
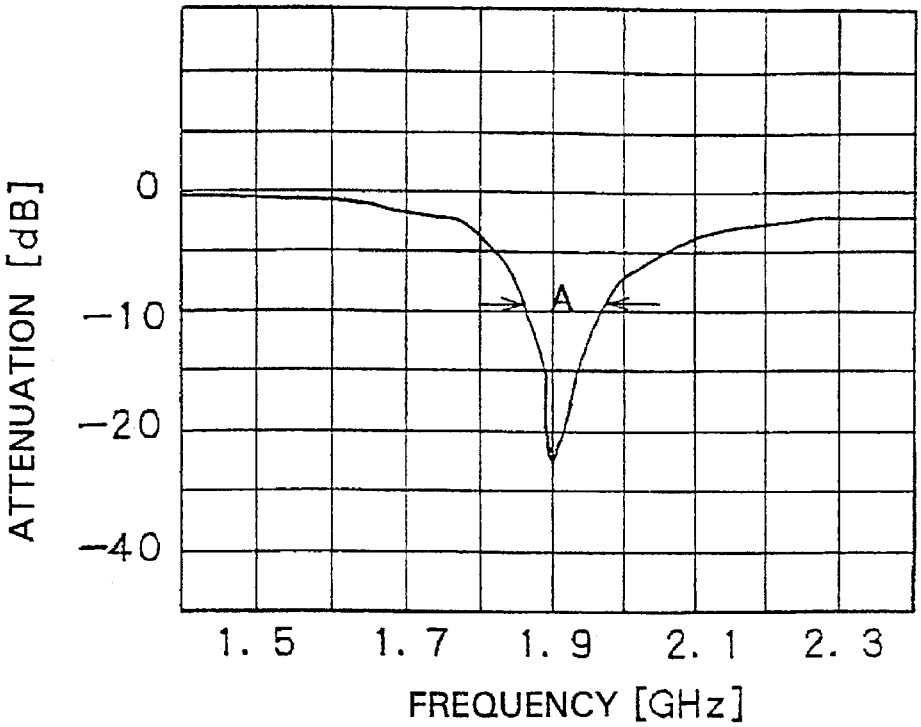
FIG. 7 is a diagram illustrating the frequency characteristics of surface-mount antennas according to the invention.
Figure 8:
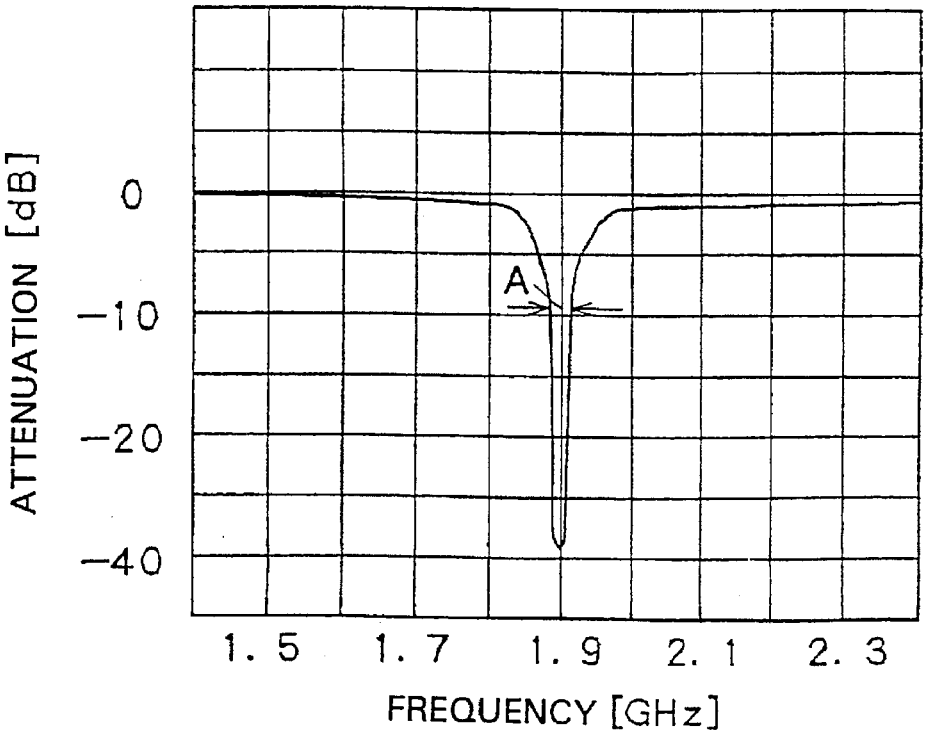
FIG. 8 PRIOR ART
FIG. 8 is a diagram illustrating the frequency characteristics of the prior art surface-mount antennas.

Specific examples of the invention are described below. Samples of the surface-mount antenna of the shape shown in FIG. 3 were manufactured on a trial basis. Each sample used the dielectric base 10 having a relative dielectric constant of 21. Each sample had a length L of 7.0 mm, a width W of 9.0 mm, and a thickness t of 4.0 mm. The frequency characteristics of the input impedance of the samples are shown in FIG. 7. For comparison, samples of the prior art structure of the shape shown in FIG. 9 were also manufactured on a trial basis. Each sample of the prior art structure used the dielectric base 31 having a relative dielectric constant of 89, and each sample had a length L of 8.6 mm, a width W of 9.0 mm, and a thickness t of 5.1 mm. The frequency characteristics of the input impedance of these samples are shown in FIG. 8. As can be seen from FIGS. 7 and 8, the passband width A of the novel structure (FIG. 7) under the condition VSWR<2 is about three times as large as the passband width of the prior art structure (FIG. 8).

A communication device having the surface-mount antenna of FIG. 1 has been described in connection with FIG. 9. Other surface-mount antennas described above can be mounted in communication devices in the same way as the foregoing.

In a surface-mount antenna according to the present invention, a radiating electrode formed in a hole extending through the dielectric base of the device is coupled to a feeding terminal via a capacitor. The radiation resistance and resonant frequency can be controlled by increasing and decreasing the capacitance of the capacitor. A smaller size can also be accomplished by adjusting the capacitance and using a dielectric base of a lower dielectric constant. Hence, the frequency band can be broadened. This means that if the same resonant frequency as used in the prior art techniques is employed, then the relative dielectric constant of the dielectric base can be lowered to reduce the Q.

Furthermore, a plurality of holes extending through the dielectric base and equipped with their respective radiating electrodes can be formed. These holes are interconnected by an electrode pattern. This contributes to a further reduction in the size.

In addition, a plurality of holes extending through the dielectric base and equipped with their respective radiating electrodes can be formed, wherein one of the holes is mainly used for coupling, while the other is used for radiation of electromagnetic waves. These two kinds of holes can be designed independently. In consequence, the resonant frequency, radiation resistance, and other factors can be designed with a greater degree of freedom.

Where plural holes equipped with their respective radiating electrodes are formed as described above, electric currents flow in different directions. As a consequence, the field directivity pattern has a reduced amount of null point.

In a communication device on which a surface-mount antenna is mounted, the antenna can be connected with the RF circuit portion with the minimum distance therebetween. Therefore, frequency deviation and matching deviation caused by the wiring pattern can be reduced. Furthermore, the total length of the communication device can be reduced.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A surface-mount antenna comprising:

a dielectric base having two opposite end surfaces;

a plurality of holes extending through said dielectric base between said two opposite end surfaces;

radiating electrodes formed in said holes, respectively, and connected to each other by an electrode pattern at one of said two opposite end surfaces, at least one of said radiating electrodes being connected with a feeding terminal via a capacitor at the other of said two opposite end surfaces; and a grounding electrode with which at least another of said radiating electrodes is connected, also at the other of said two opposite end surfaces.

2. The surface-mount antenna of claim 1, wherein an electrodeless hole is formed between said plurality of holes, extending through said dielectric base between said two opposite end surfaces of said dielectric base.

3. The surface-mount antenna of any one of claim 1, wherein said feeding electrode is formed in said dielectric base, and wherein said capacitor is formed by said feeding terminal, said radiating electrode, and a part of said dielectric base therebetween.

4. A surface-mount antenna comprising:

a dielectric base having first and second end surfaces opposite to each other;

a first hole having a relatively short axial length and extending through said dielectric base between said first and second end surfaces;

a second hole having a relatively long axial length and extending through said dielectric base between said first and second end surfaces;

a step portion formed at said first end surface between said first hole and said second hole;

first and second radiating electrodes formed in said first and second holes, respectively;

an electrode pattern formed on said second end surface of said dielectric base, said first and second radiating electrodes being connected by said electrode pattern;

a feeding terminal with which said first radiating electrode is connected via a capacitor at said first end surface of said dielectric base; and a grounding electrode with which said second radiating electrode is connected at said first end surface.

5. A surface-mount antenna comprising:

a dielectric base having two opposite end surfaces;

at least one hole extending through said dielectric base between said two opposite end surfaces;

a radiating electrode formed in said hole;

a grounding electrode formed at one of said two opposite end surfaces, one end of said radiating electrode electrically connected with said grounding electrode; and a feeding terminal with which another end of said radiating electrode is connected via a capacitor;

wherein said capacitor is formed by a metal rod connected to said feeding terminal, said radiating electrode, and a dielectric member on said metal rod.

6. The surface-mount antenna of any one of claims 1–4, wherein said capacitor is formed by a metal rod connected to said feeding terminal, said radiating electrode, and a dielectric member on said metal rod.

7. A communication device having a mounting board with a signal conductor, a ground conductor, and communication circuits thereon, and a surface-mount antenna of any one of claims 1–4 mounted on said mounting board with its feeding terminal and grounding electrode connected respectively to said signal conductor and said ground conductor.

* * * * *